US008468915B2

(12) United States Patent
Hu

(10) Patent No.: US 8,468,915 B2
(45) **Date of Patent: *Jun. 25, 2013**

(54) COMPACT TOOL BOX WITH RATCHET DRIVING FUNCTION

(76) Inventor: Bobby Hu, Taichung (TW)

( * ) Notice: Subject to any disclaimer, the term of this patent is extended or adjusted under 35 U.S.C. 154(b) by 359 days.

This patent is subject to a terminal disclaimer.

(21) Appl. No.: 12/877,279

(22) Filed: Sep. 8, 2010

(65) Prior Publication Data

US 2011/0088519 A1 Apr. 21, 2011

(30) Foreign Application Priority Data

Oct. 15, 2009 (TW) ..... 98134973 A

(51) Int. Cl.
*B25B 15/04* (2006.01)
*B25B 23/16* (2006.01)

(52) U.S. Cl.
USPC ..... 81/63.1; 81/177.4; 81/439

(58) Field of Classification Search
USPC ..... 81/63.1, 60, 177.4, 490, 439
See application file for complete search history.

(56) References Cited

U.S. PATENT DOCUMENTS

| | | | | |
|---|---|---|---|---|
| 4,934,223 | A * | 6/1990 | Wong | 81/490 |
| 5,522,291 | A * | 6/1996 | Liu | 81/490 |
| 6,101,654 | A * | 8/2000 | Cachot | 7/128 |
| 6,243,902 | B1 | 6/2001 | Huang | 7/165 |
| 6,405,865 | B1 * | 6/2002 | Lin | 206/379 |
| 7,032,483 | B2 | 4/2006 | Liu | 81/490 |
| 8,038,004 | B2 * | 10/2011 | Hu | 81/490 |
| 2008/0178712 | A1 * | 7/2008 | Brown | 81/450 |

* cited by examiner

*Primary Examiner* — Hadi Shakeri
(74) *Attorney, Agent, or Firm* — Alan Kamrath; Kamrath IP Lawfirm, P.A.

(57) ABSTRACT

A tool box includes a body having a front end spaced from a force-receiving portion. The body includes first and second sides and two lateral walls. The lateral walls, the front end, and the force-receiving portion are integrally formed as a single and inseparable component of the same material. The front end includes a compartment. A receiving space is defined between the lateral walls and has an opening in the second side or the force-receiving portion. A ratcheting mechanism includes a main body mounted in the body and a ratchet wheel rotatably received in the main body. The ratchet wheel is located in a quarter corner of the body adjacent to the front end and the first side. A driving groove is defined in the ratchet wheel for engaging and driving a shank to rotate. A bit-receiving rack is removably received in the receiving space.

18 Claims, 14 Drawing Sheets

COMPACT TOOL BOX WITH RATCHET DRIVING FUNCTION

BACKGROUND OF THE INVENTION

The present invention relates to a compact tool box with a ratcheting driving function and, more particularly, to a tool box that can be used in a corner of a wall and that is small in size while providing a force-saving driving effect.

U.S. Pat. No. 6,243,902 discloses a tool handle combination including a driving stem mounted to a handle body. The handle body has a base and a cover mounted on top of the base. The cover and the base together define a space for receiving bits, sockets or other tools. Such a tool handle combination is not easy to carry due to the considerable length of the driving stem. The objects are received in the space, and the handle body is substantially cubic that can not be effectively reduced in width or height. A user can apply a force along the longitudinal axis of the driving stem to engage the bit with a workpiece such as a screw. Furthermore, the user can apply a force in a clockwise or counterclockwise direction for rotating the driving stem about the longitudinal axis. However, the force applied by the user is limited, because the width and the height of the handle body are approximately the same. Namely, rotating the tool handle combination is laborsome. Furthermore, the repeatedly openable cover can not effectively transmit the force applied by the user. Further, the cover is liable to slide relative to the base or to deform when the user intends to apply large torque, leading to loss of kinetic energy during transmission. As a result, the user often feels difficulty during operation. In worse conditions, the handle body could be damaged by the large torque.

U.S. Pat. No. 6,405,865 discloses a tool box including a body and a cap movably mounted to the body. The body includes a board and a post extending from the board. A plurality of passages is defined through the post for receiving long bits and bits. An engaging recess is defined in a distal end of the post for selectively receiving a long bit or a bit. When not in use, the long bit can be removed from the engaging recess and stored in one of the passages, allowing easy carriage. The passages extend perpendicularly through two sides of the post in a lateral direction, and the cover houses the post. Thus, the overall width extends in the lateral direction to reduce the profile of the overall tool box, providing a pocket-size or compact tool box. However, the repeatedly removable cap can not effectively transmit the force applied by the user. Furthermore, the cover is liable to slide relative to the body or to deform when the user intends to apply large torque, leading to loss of kinetic energy during transmission. As a result, the user often feels difficulty during operation. In worse conditions, the body could be damaged by the large torque.

U.S. Pat. No. 7,032,483 discloses a toolbox driver including a base, a first bracket pivotally mounted to a side of the base, and a second bracket pivotally mounted to the other side of the base spaced from the side of the base in a lateral direction. The second base receives a plurality of screwdriver heads. The base includes an insertion hole for engaging with a screwdriver rod when in use. The first bracket includes a receptacle hole for receiving the screwdriver rod when not in use, allowing easy carriage. The width of the overall tool box extends in the lateral direction to reduce the height of the tool box, providing a pocket-size or compact tool box. However, the pivotable first and second brackets can not effectively transmit the force applied by the user. Furthermore, the first or second bracket is liable to slide relative to the base or to deform when the user intends to apply large torque, leading to loss of kinetic energy during transmission. As a result, the user often feels difficulty during operation. In worse conditions, the base could be damaged by the large torque. Further, even though the receptacle hole of the first bracket is located adjacent to the side of the base, rotation of the toolbox is not smooth when driving a screw in a limited space such as a corner of a wall, because the user has to repeatedly disengage the screwdriver head from the screw and reengage the screwdriver with the head of the screw. Further, the receptacle hole has differing spacings to the edges of the base, leading to limitation to the use of the toolbox.

Thus, a need exists for a compact tool box that can be used in a corner of a wall and that is small in size while providing a force-saving driving effect.

BRIEF SUMMARY OF THE INVENTION

The present invention solves this need and other problems in the field of compact tool boxes with reliable operation by providing, in a preferred form, a tool box including a body having a front end and a force-receiving portion spaced from the front end in a first direction. The body further includes first and second sides spaced in a second direction perpendicular to the first direction. The body further includes first and second lateral walls spaced in a third direction perpendicular to the first and second directions and extending between the front end and the force-receiving portion. The first and second lateral walls, the front end, and the force-receiving portion are integrally formed as a single and inseparable component of the same material. The front end includes a compartment. A receiving space is defined between the first and second lateral walls and has an opening in the second side or the force-receiving portion. A ratcheting mechanism includes a main body mounted in the body, a ratchet wheel rotatably received in the main body, and a switch device for controlling the ratchet wheel to be rotatable in a clockwise or counterclockwise direction or to be not rotatable in either of the clockwise and counterclockwise directions. The ratchet wheel is rotatable about a rotating axis parallel to the first direction. The ratchet wheel is located in a quarter corner of the body adjacent to the front end and the first side. A driving groove is defined in an end of the ratchet wheel and extends along the rotating axis. The driving groove is adapted for engaging and driving a shank to rotate. A rack is removably received in the receiving space of the body via the opening. The rack is adapted to receive a plurality of bits.

In preferred forms, the force-receiving portion includes an insertion groove extending in the first direction and along the rotating axis and in communication with the compartment of the body. The insertion groove includes first and second sections. The first section has an opening in the force-receiving portion. The second section is intermediate the first section and the compartment. The second section has an inner diameter smaller than that of the first section. The first and second sections respectively receive large and small diameter portions of the shank when not in use.

In a preferred form, the other end of the ratchet wheel includes a cylindrical receiving groove extending along the rotating axis and having an inner diameter larger than that of the driving groove. The receiving groove receives a portion of the shank inserted in the insertion groove.

In another preferred form, the main body of the ratcheting mechanism includes a cylindrical receiving groove extending along the rotating axis and having an inner diameter larger than that of the driving groove. The receiving groove receives a portion of the shank inserted in the insertion groove.

In preferred forms, the rack includes a mounting portion having a plurality of bit-receiving grooves for receiving the bits. The bit-receiving grooves are arranged in a single row in the first direction.

In preferred forms, a first maximum dimension of the body in the first direction between the front end and the force-receiving portion defines a first spacing. A second maximum dimension of the body in the second direction between the first and second sides defines a second spacing. A third maximum dimension of the body in the third direction between the first and second lateral walls defines a third spacing. The third spacing is smaller than the second spacing. The second spacing is smaller than the first spacing. The body has a first radius and a second radius in the second direction and having the same rotating axis. The first radius is equal to a spacing between the first side of the body and the rotating axis in the second direction. The second radius is equal to a spacing between the second side of the body and the rotating axis in the second direction. The second spacing is equal to a sum of the first radius and the second radius. The second radius is larger than the first radius. The first radius is smaller than the third spacing and preferably not larger than half of the third radius. The rotating axis of the ratchet wheel has equal spacing to the first and second lateral walls in the third direction.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
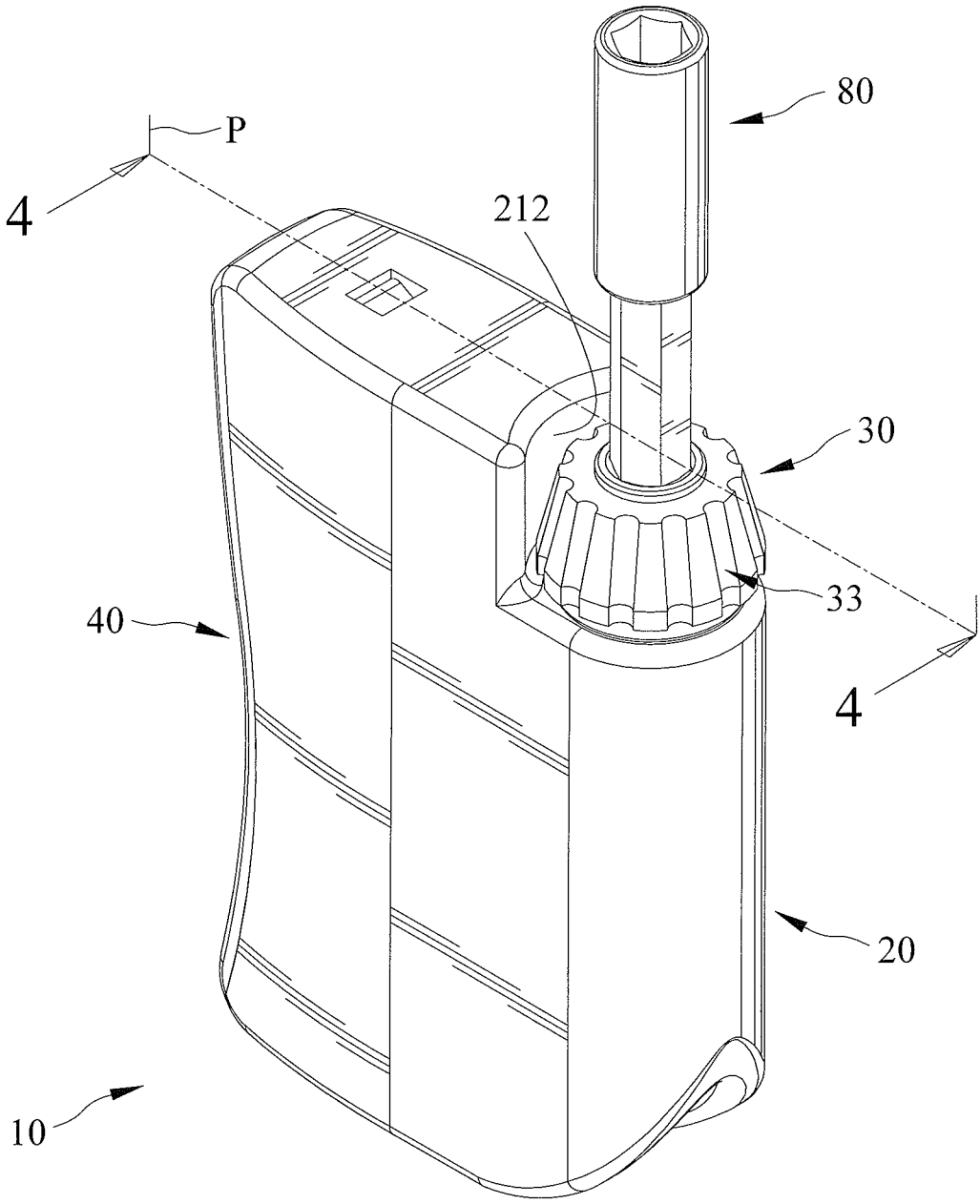
FIG. 1 shows a perspective view of a compact tool box of a first embodiment according to the preferred teachings of the present invention.
Figure 2:
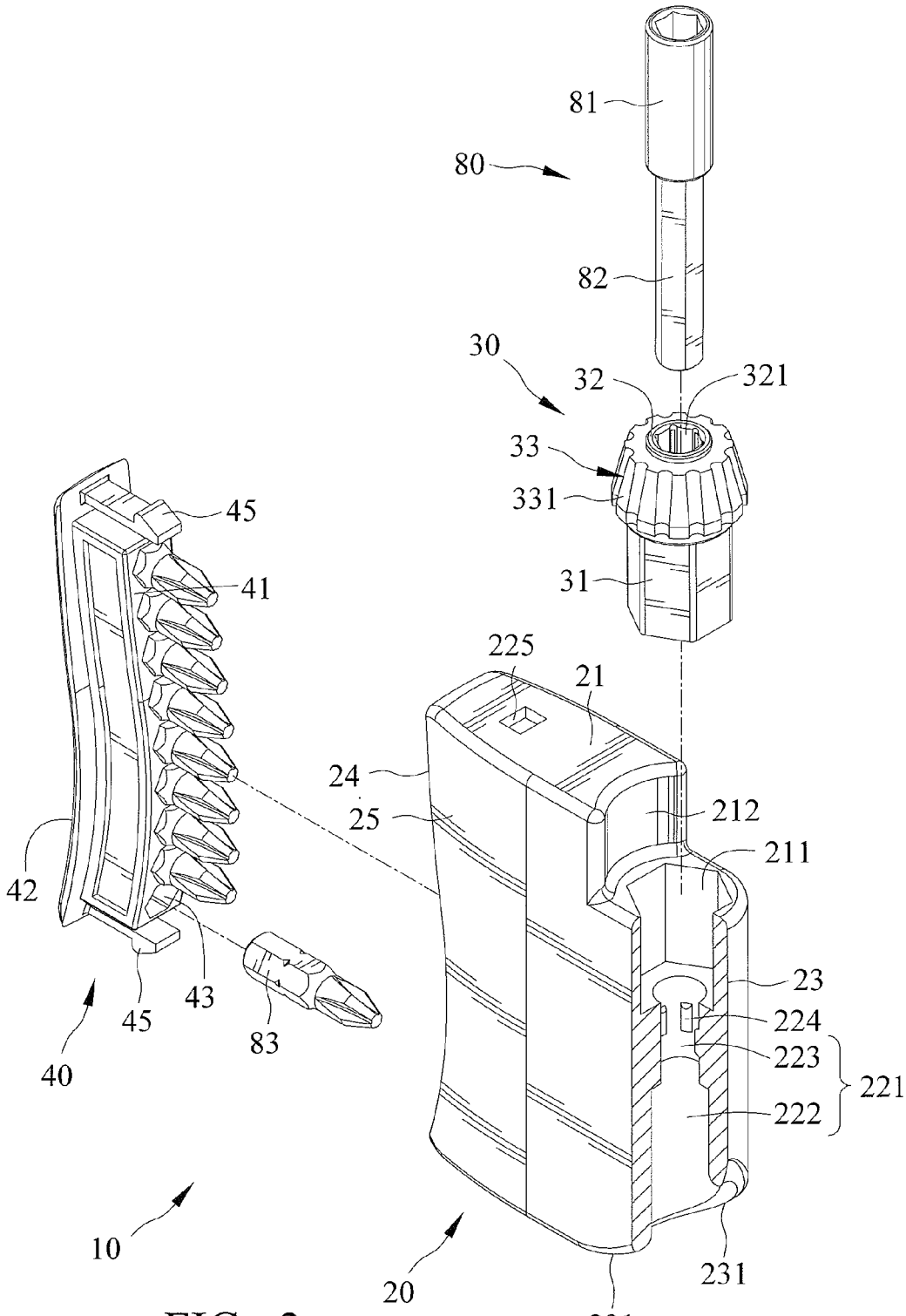
FIG. 2 shows an exploded, perspective view of the compact tool box of FIG. 1 with portions broken away.
Figure 3:
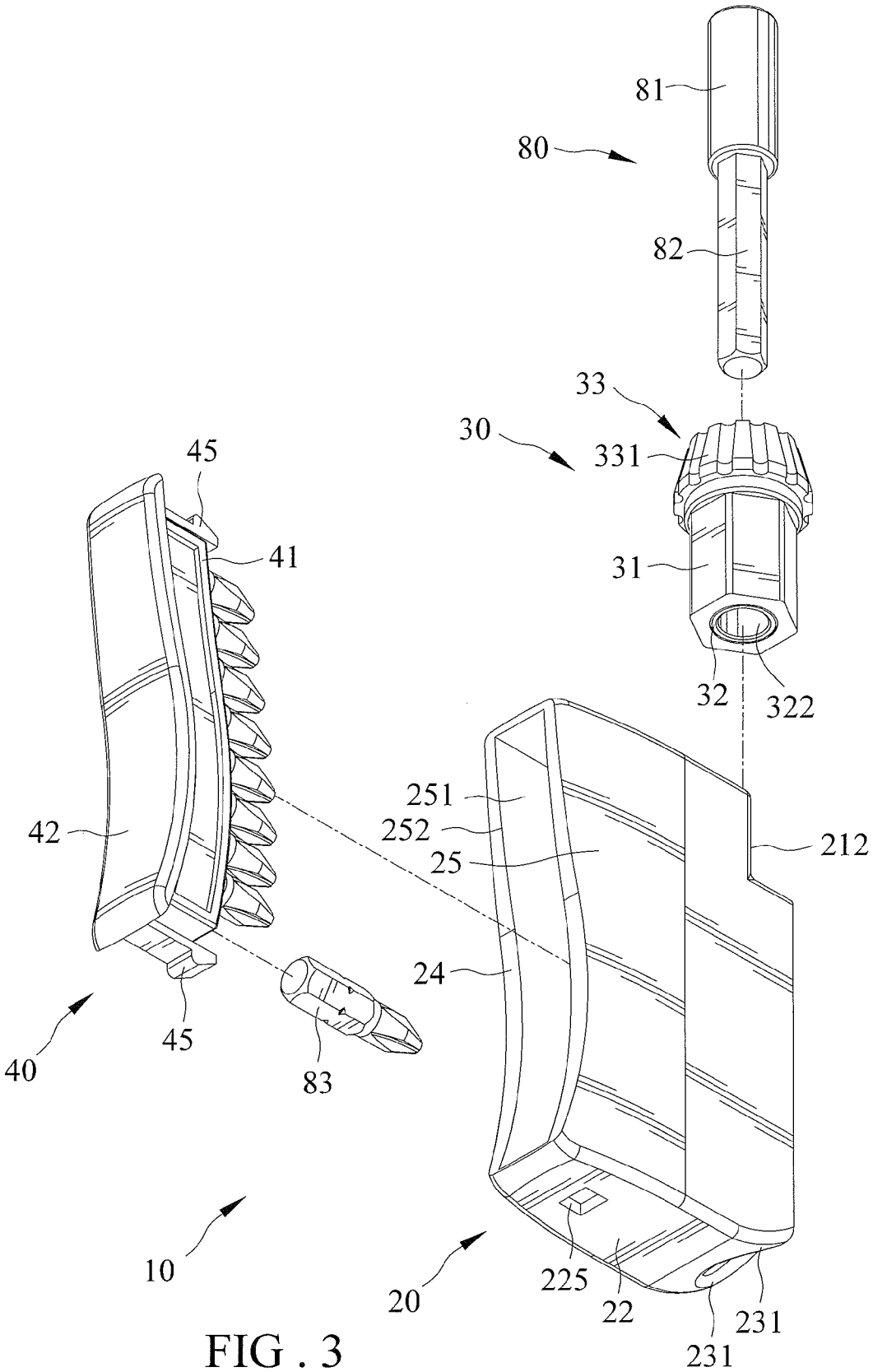
FIG. 3 shows another exploded, perspective view of the compact tool box of FIG. 1.
Figure 4:
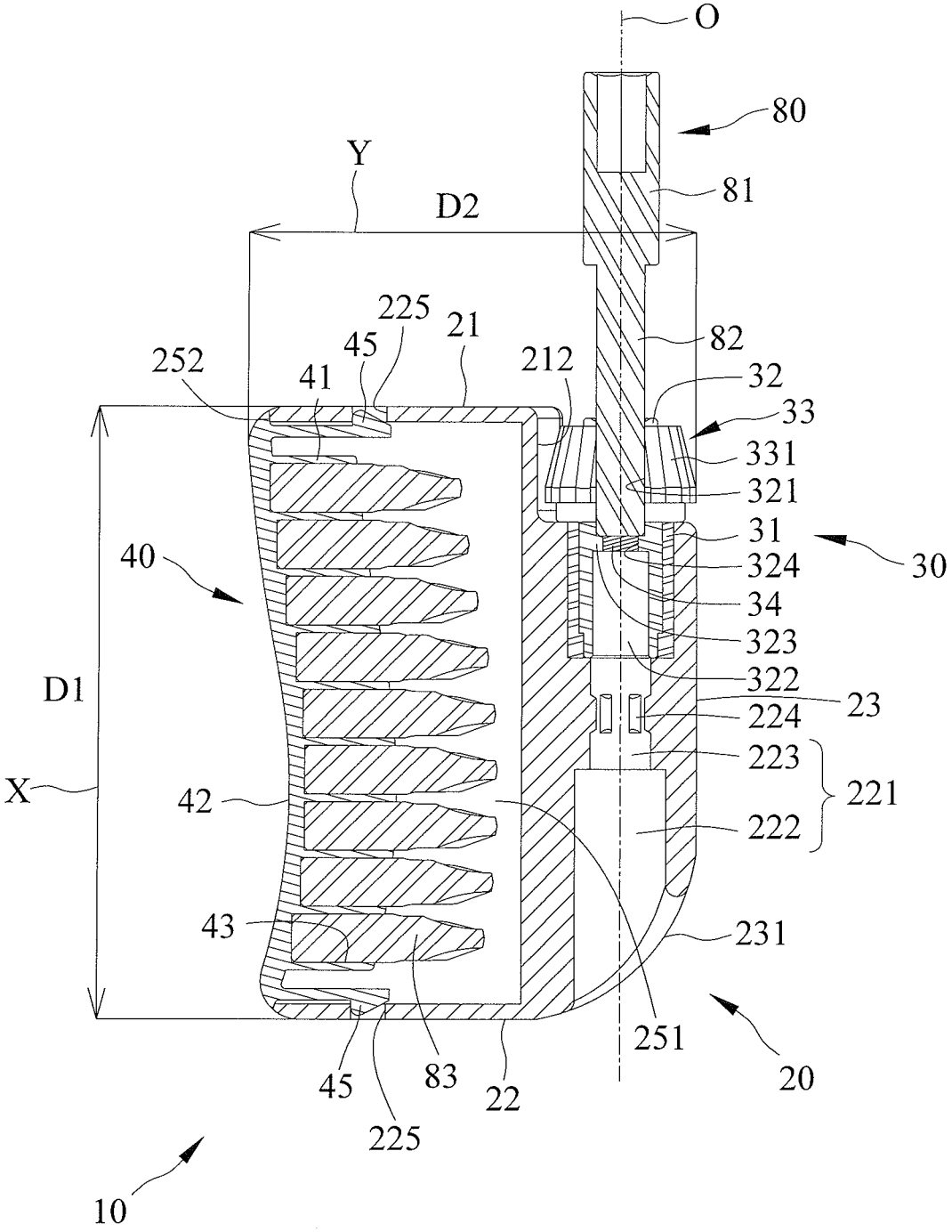
FIG. 4 shows a cross sectional view of the compact tool box of FIG. 1 according to section line 4-4 of FIG. 1.
Figure 5:
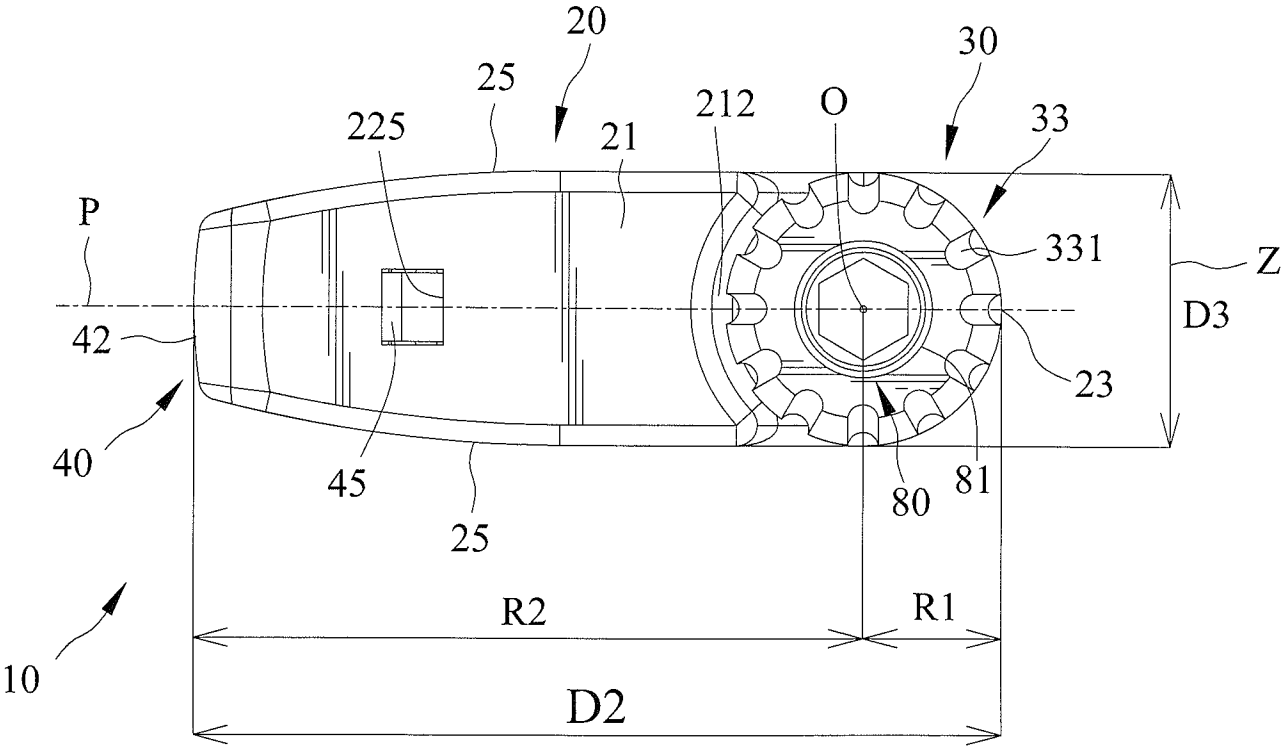
FIG. 5 shows a top view of the compact tool box of FIG. 1.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "axial", "lateral", "annular", "spacing", "clockwise", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to FIGS. 1-9, a tool box 10 of a first embodiment according to the preferred teachings of the present invention includes a body 20, a ratcheting mechanism 30, and a rack 40.

Body 20 is substantially a parallelepiped and includes a front end 21 and a force-receiving portion 22 spaced from front end 21 in a first direction X. Body 20 further includes first and second sides 23 and 24 spaced in a second direction Y perpendicular to first direction X and extending between front end 21 and force-receiving portion 22. Body 20 further includes two lateral walls 25 spaced in a third direction Z perpendicular to first and second directions X and Y and extending between front end 21 and force-receiving portion 22 and between first and second sides 23 and 24. Lateral walls 25, front end 21 and force-receiving portion 22 are integrally formed as a single and inseparable component of the same material.

A first maximum dimension of body 20 in first direction X between front end 21 and force-receiving portion 22 defines a first spacing D1. A second maximum dimension of body 20 in second direction Y between first and second sides 23 and 24 defines a second spacing D2. A third maximum dimension of body 20 in third direction Z between lateral walls 25 defines a third spacing D3. Third spacing D3 is smaller than second spacing D2, which, in turn, is smaller than first spacing D1.

Front end 21 of body 20 includes a compartment 211. Force-receiving portion 22 is adapted to receive force applied from the palm and a part of the hand between the thumb and the index finger of a user during driving of a fastener 90 (FIG. 7) such that fastener 90 can be effectively pressed against an object to be tightened. Force-receiving portion 22 includes a stepped insertion groove 221 for receiving a shank 80. Stepped insertion groove 221 extends in the first direction X and is in communication with compartment 211.

Insertion groove 221 includes first and second sections 222 and 223. First section 222 has an opening in force-receiving portion 22. Second section 223 is in communication with compartment 211 and has an inner diameter smaller than that of first section 222. Second section 223 is intermediate first section 222 and compartment 211. First section 222 can receive a large diameter portion 81 of shank 80, and second section 223 can receive a small diameter portion 82 of shank 80. A plurality of annularly spaced protrusions 224 is formed on an inner periphery of second section 223 for clamping small diameter portion 82. In this embodiment, second section 223 has six protrusions for clamping six sides of small diameter portion 82 of shank 80. Since insertion groove 221 is in communication with compartment 211, small diameter portion 82 of shank 80 can be partially extended into and received in compartment 211 for storage purposes when not in use.

First side 23 of body 20 includes a rounded outer face with a rounded corner 231 formed in a joining area between first side 23 and force-receiving portion 22. Thus, force-receiving portion 22 is smoothly connected to first side 23 to provide comfortable contact for the part of the hand between the thumb and the index finger of the user at rounded corner 231.

Since lateral walls 25, front end 21 and force-receiving portion 22 are integrally formed as a single and inseparable component of the same material, the structural strength of body 20 can be effectively enhanced. A receiving space 251 is defined between lateral walls 25 and has an opening in second side 24 or force-receiving portion 22. In this embodiment, receiving space 251 has an opening 252 in second side 24. Lateral walls 25 provide a large contact area for the fingers of the user such that the rotating force applied by the user can be effectively transmitted to fastener 90 through tool box 10. Furthermore, lateral walls 25 are symmetric to each other and, thus, suitable for both right-handed and left-handed users without limitation in the direction, allowing wider application of the product.

Ratcheting mechanism 30 includes a main body 31, a hollow ratchet wheel 32 rotatably received in main body 31, and a switch device 33 for controlling ratchet wheel 32 to be rotatable in a clockwise or counterclockwise direction or to be not rotatable in either of the clockwise and counterclockwise directions. Main body 31 is engaged in compartment 211 of body 20 and is fixed relative to body 20.

Ratchet wheel 32 is received in main body 31 and rotatable about a rotating axis O parallel to first direction X. A driving groove 321 is defined in an end of ratchet wheel 32 and extends along rotating axis O of ratchet wheel 32. Driving groove 321 has non-circular cross sections for driving shank 80 to rotate. In this embodiment, driving groove 321 of ratchet wheel 32 has hexagonal cross sections for engaging with shank 80 with six sides. Furthermore, insertion groove 221 of body 20 extends along rotating axis O of ratchet wheel 32.

The other end of ratchet wheel 32 opposite to driving groove 321 includes a cylindrical receiving groove 322 extending along rotating axis O and having an inner diameter larger than that of driving groove 321. Receiving groove 322 can receive a portion of small diameter portion 82 of shank 80 inserted in insertion groove 221, effectively reducing first spacing D1 and allowing easy carriage of body 20. A stop 323 is formed between driving groove 321 and receiving groove 322 to stop smaller diameter portion 82 of shank 80, preventing shank 80 from extending through ratchet wheel 32. Stop 323 of ratchet wheel 32 includes a through-hole 324 in which a magnet 34 is securely received. Magnet 34 attracts smaller diameter portion 82 of shank 80 received in driving groove 321 or receiving groove 322, increasing engagement effect between ratchet wheel 32 and shank 80.

Switch device 33 of ratcheting mechanism 30 includes a switch 331 and a plurality of engagement members (not shown) capable of resiliently engaging with ratchet wheel 32. In an example, switch device 33 includes two engagement members, and switch 331 can be operated to control an engagement relation between the two engagement members and ratchet wheel 32 such that ratchet wheel 32 is rotatable in a clockwise or counterclockwise direction or not rotatable in either of the clockwise and counterclockwise directions. Body 20 includes an exposed portion 212 for receiving switch device 33. Thus, switch device 33 is exposed outside of body 20 to allow operation by the user. In this embodiment, switch 331 is of rotational type. Furthermore, exposed portion 212 is in the form of a recessed portion in a corner of body 20 adjacent to front end 21 and first side 23. The recessed portion includes a first section spaced from first side 23 in second direction Y and a second section spaced from front end 21 in first direction X. Furthermore, compartment 211 is defined in the second section of the recessed portion. This arrangement allows easy rotation of switch 331.

Rack 40 is mounted into receiving space 251 via opening 252 of body 20. Furthermore, rack 40 can be removed from body 20 via second side 24. Receiving space 251 can be sealed by rack 40 in a storage position received in receiving space 251. Rack 40 includes a mounting portion 41 facing receiving space 251 and an outer side 42 opposite to receiving space 251. Outer side 42 seals opening 252 of receiving space 251. Mounting portion 41 of rack 40 includes a plurality of bit-receiving grooves 43 for receiving bits 83. Bit-receiving grooves 43 are arranged in a single row in first direction X such that receiving space 251 of body 20 only receives a row of bits 83, effectively reducing third spacing D3 of body 20 in third direction Z and allowing easy carriage of tool box 10.

Rack 40 includes an engaging portion 45 in each of two ends thereof. Body 20 includes two engaging grooves 225 respectively in front end 21 and force-receiving portion 22 and located adjacent to second side 24. Each engaging groove 225 is in the form of a slot in this embodiment. Engaging portions 45 of rack 40 are engaged in engaging grooves 225 to prevent undesired disengagement of rack 40 from receiving space 251. However, engaging portions 45 can be manually disengaged from engaging grooves 225 to allow removal of rack 40.

Body 20 includes a first radius R1 and a second radius R2 in second direction Y and having a common rotating axis O. Specifically, first radius R1 is equal to a spacing between first side 23 of body 20 and rotating axis O in second direction Y, and second radius R2 is equal to a spacing between second side 24 of body 20 and rotating axis O in second direction Y. Second spacing D2 is equal to the sum of first radius R1 and second radius R2. Furthermore, second radius R2 is larger than first radius R1. First radius R1 is smaller than third spacing D3.

Since second radius R2 is larger than first radius R1, the arm of force for rotating tool box 10 is increased, obtaining a force-saving driving effect. Furthermore, since first radius R1 is smaller than third spacing D3, tool box 10 can be utilized in a limited space such as a corner of a wall. Preferably, first radius R1 is not larger than half of third spacing D3. Thus, tool box 10 can be rotated through a large angle in a limited space such as a corner of a wall.

Ratchet wheel 32 is located in a quarter corner of body 20 adjacent to front end 21 and first side 23. The "quarter corner" of body 20 is an area within a half of first spacing D1 starting from front end 21 and within a half of second spacing D2 starting from first side 23. This arrangement allows tool box 10 to provide the maximum force-saving effect while having the minimized volume. This arrangement also allows tool box 10 to be used in a corner of a wall.

Rotating axis O of ratchet wheel 32 lies in a plane P perpendicular to third direction Z. Plane P equally divides third spacing D3. Namely, plane P is located in a center of third spacing D3. Specifically, rotating axis O of ratchet wheel 32 has an equal spacing to lateral walls 25 in third direction Z. Thus, the force rotating tool box 10 can be equally distributed to lateral walls 25. Since lateral walls 25 are on opposite sides of and symmetric relative to rotating axis O, no stress concentration will occur at either lateral wall 25.

Figure 6:
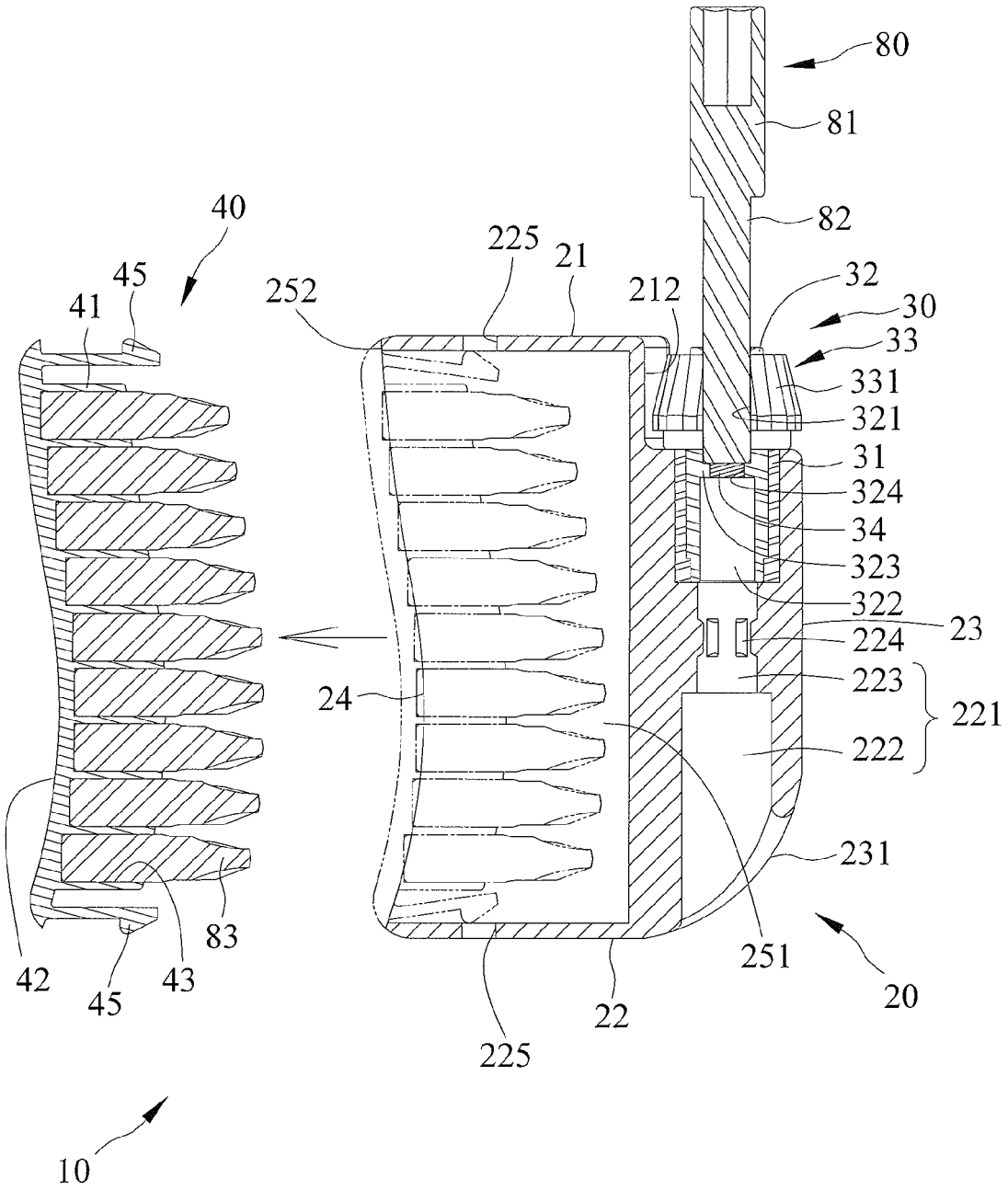
FIG. 6 shows a cross sectional view of the compact tool box of FIG. 1 with a mounting plate disengaged from a body of the compact tool box.

FIG. 6 shows removal of rack 40 from body 20. When it is desired to proceed with a driving operation, smaller diameter portion 82 of shank 80 is inserted into driving groove 321 of ratchet wheel 32. Rack 40 is removed from body 20 by disengaging engaging portions 45 from engaging grooves 225. The user can pick the desired bit 83.

Figure 7:
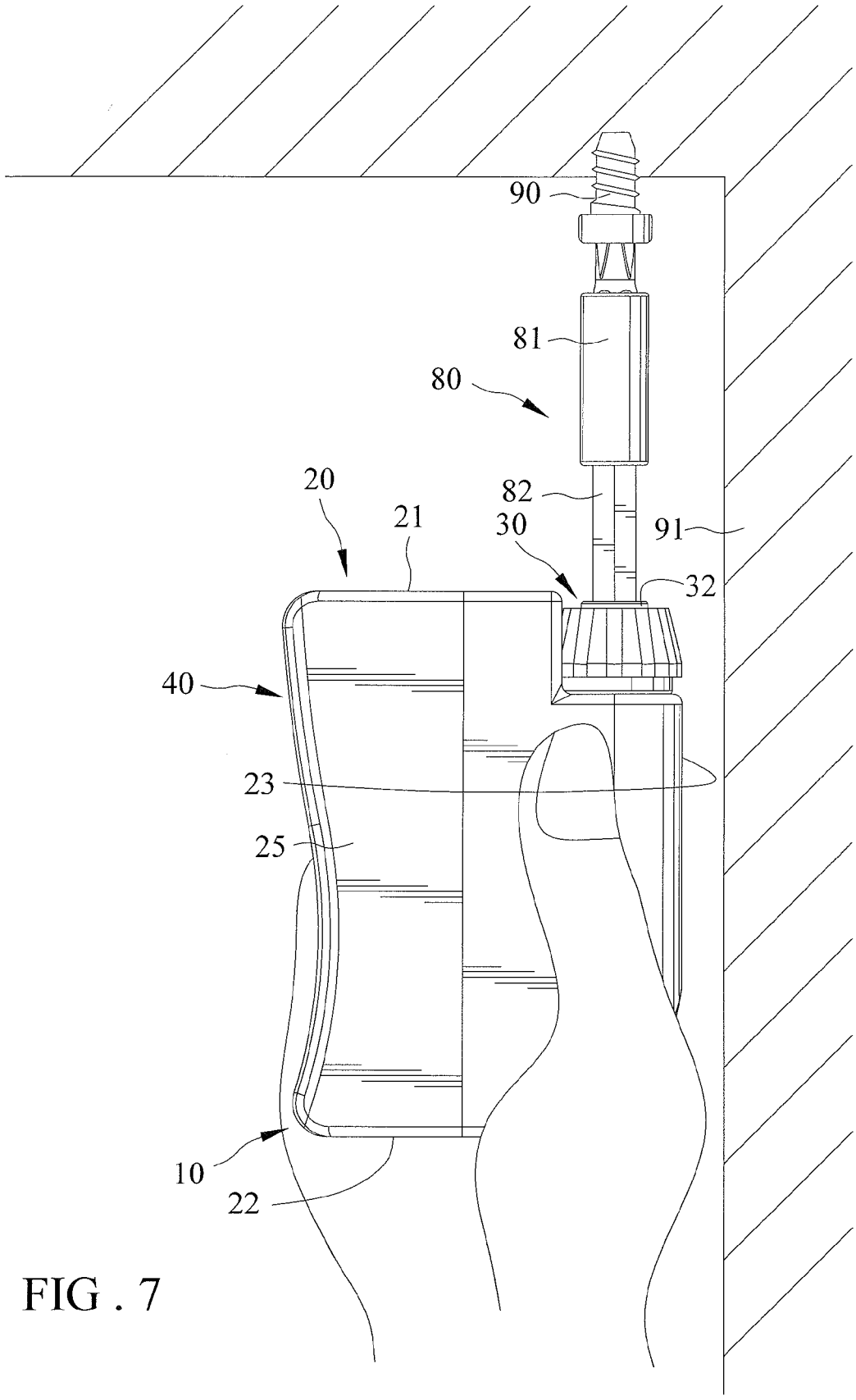
FIG. 7 is a schematic view illustrating use of the compact tool box of FIG. 1 in a corner of a wall.

FIG. 7 shows use of tool box 10 according to the preferred teachings of the present invention in a corner 91 of a wall. After engaging a bit 83 with large diameter portion 81 of shank 80, fastener 90 in corner 91 can be driven by tool box 10 to rotate in a desired direction.

Since ratchet wheel 32 is located in the quarter corner adjacent to front end 21 and first side 23 of body 20 and since second radius R2 is larger than first radius R1 (FIG. 5), lateral walls 25 can effectively increase the arm of force during rotation of tool box 10, obtaining the best force-saving effect. Furthermore, since first radius R1 is smaller than third spacing D3, first side 23 is close to corner 91 of the wall during rotation of tool box 10, allowing use of tool box 10 in a limited space.

Figure 8:
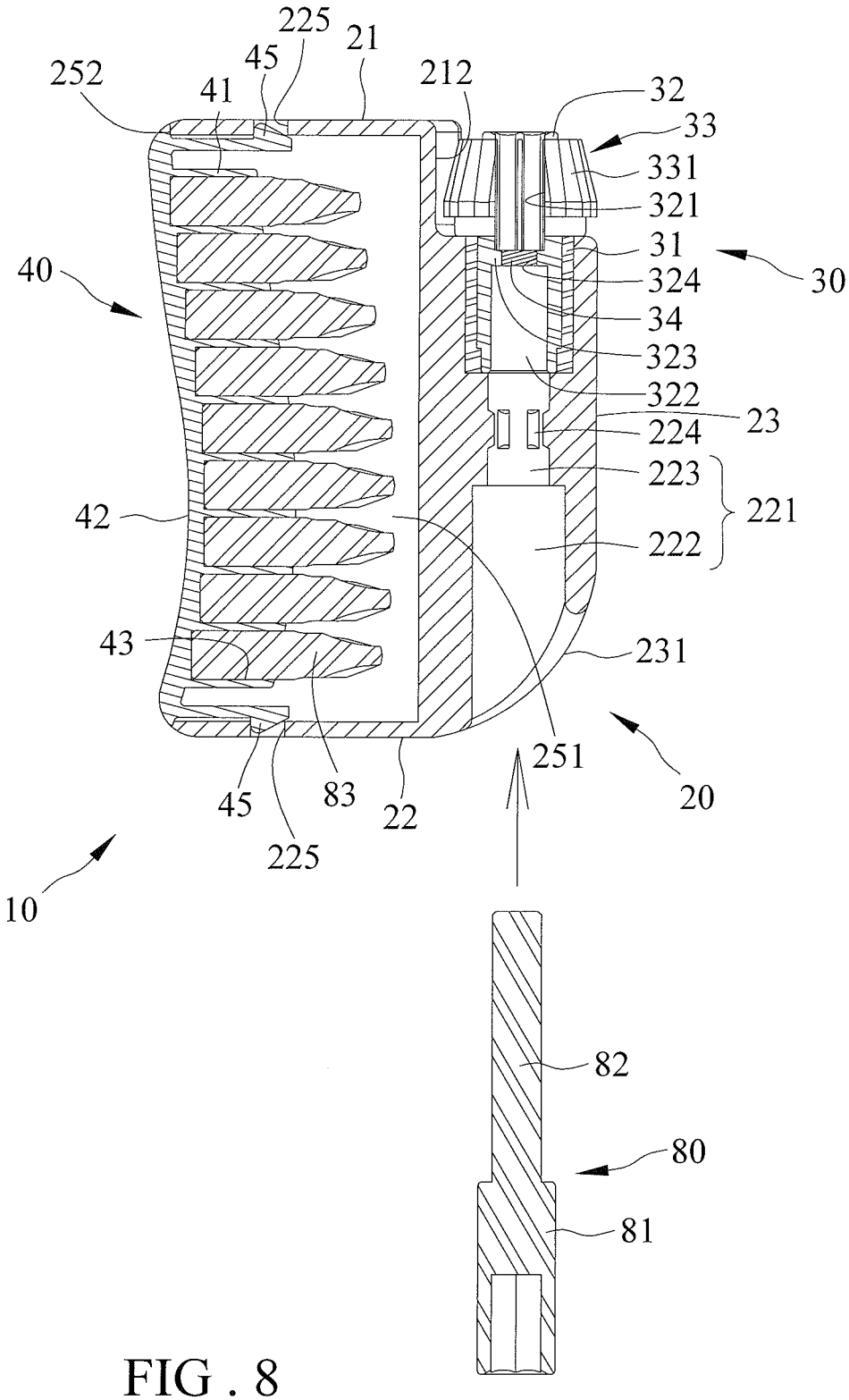
FIG. 8 shows a cross sectional view of the compact tool box of FIG. 1 illustrating insertion of a shank into the body.
Figure 9:
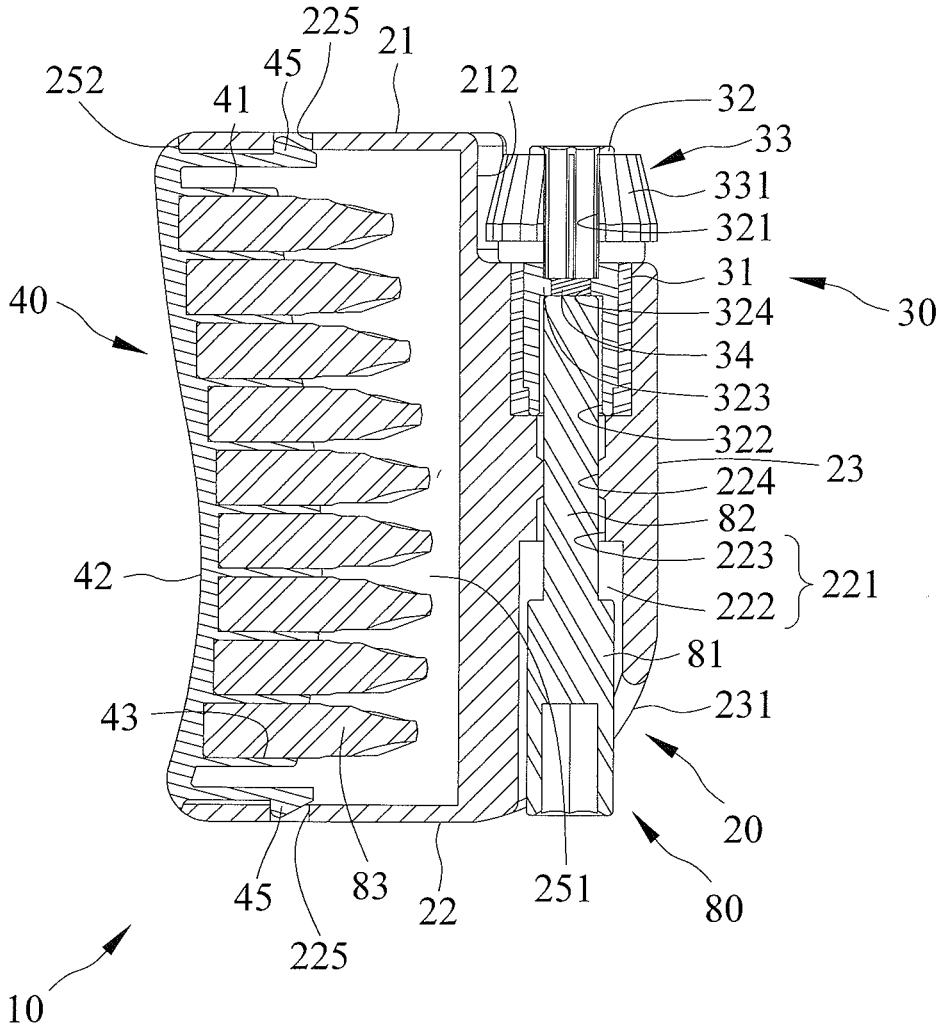
FIG. 9 shows a cross sectional view similar to FIG. 8 with the shank received in the body.

FIGS. 8 and 9 show storage of shank 80 in tool box 10. Specifically, when not in use, shank 80 is removed from driving groove 321 of ratchet wheel 32 and inserted into insertion groove 221 of tool box 10 after rotating 180°.

Annularly spaced protrusions 224 of second section 223 of insertion groove 221 clamp small diameter portion 82 of shank 80. Since the inner diameter of receiving groove 322 of ratchet wheel 32 is larger than driving groove 321, receiving groove 322 can receive a portion of small diameter portion 82 of shank 80 inserted in insertion groove 221. This arrangement effectively reduces first spacing D1 of body 20 (FIG. 4) to allow easy carriage of body 20.

Figure 10:
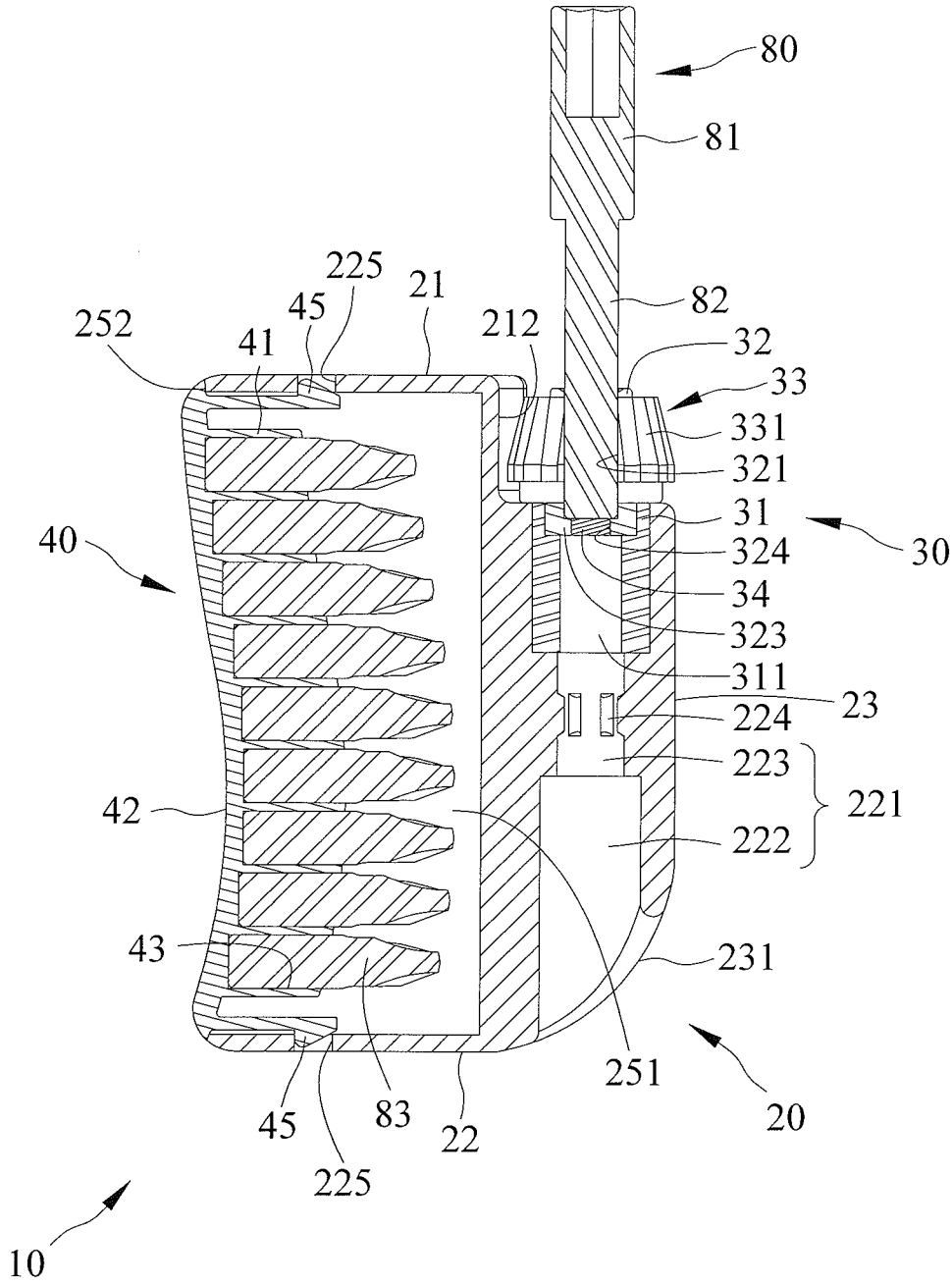
FIG. 10 shows a cross sectional view of a compact tool box of a second embodiment according to the preferred teachings of the present invention.
Figure 11:
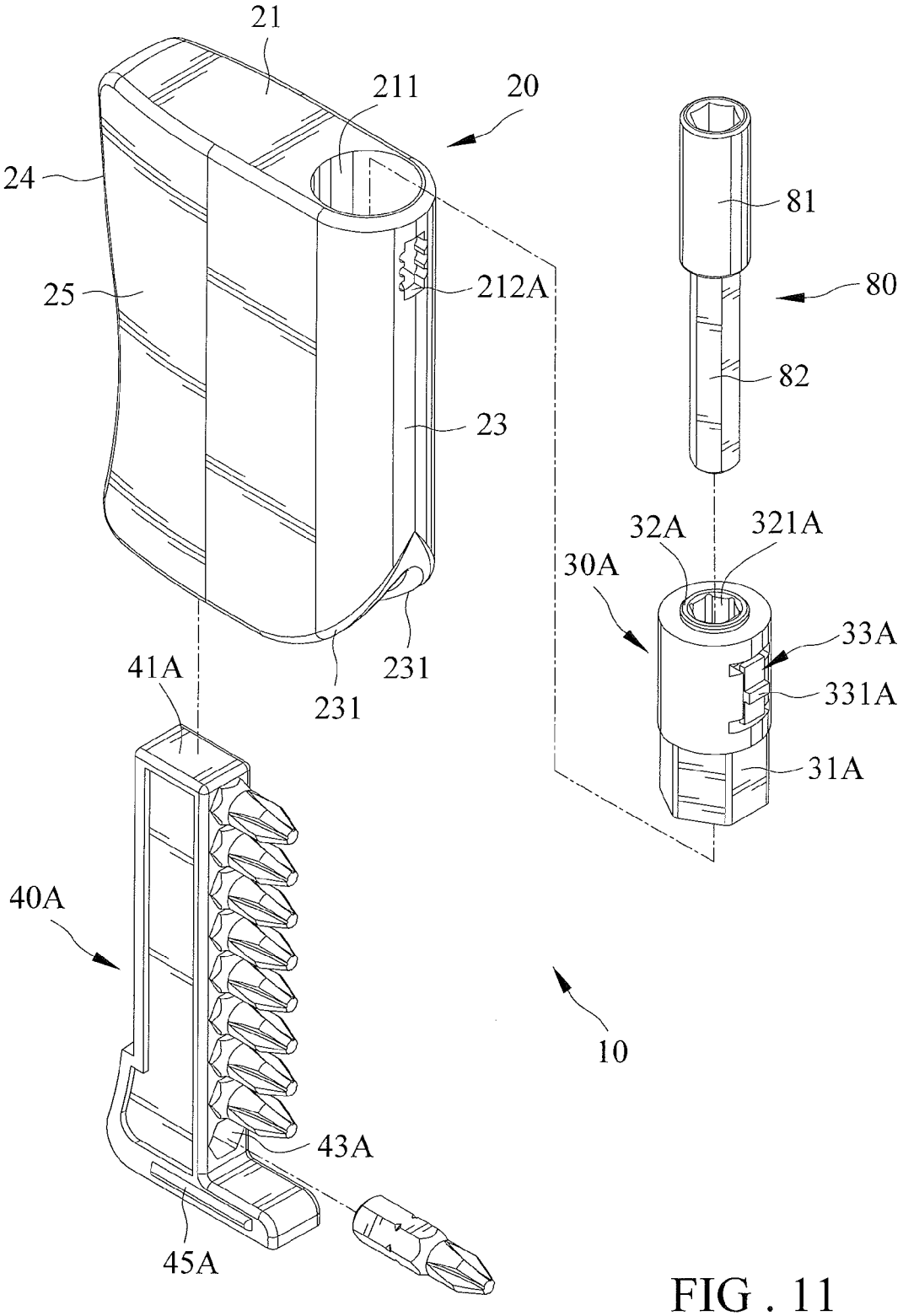
FIG. 11 shows an exploded, perspective view of a compact tool box of a third embodiment according to the preferred teachings of the present invention.
Figure 12:
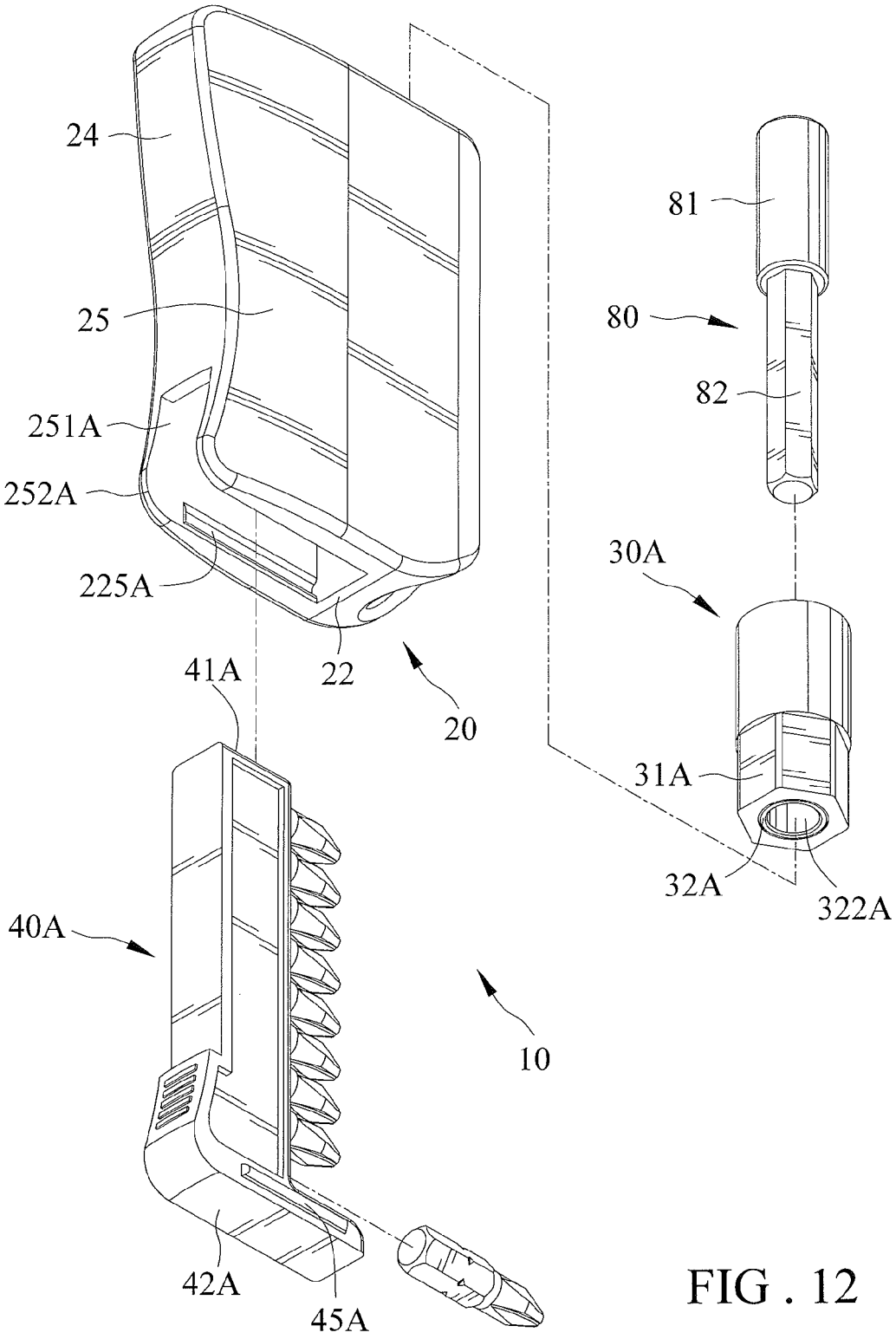
FIG. 12 shows another exploded perspective view of the compact tool box of FIG. 11.
Figure 13:
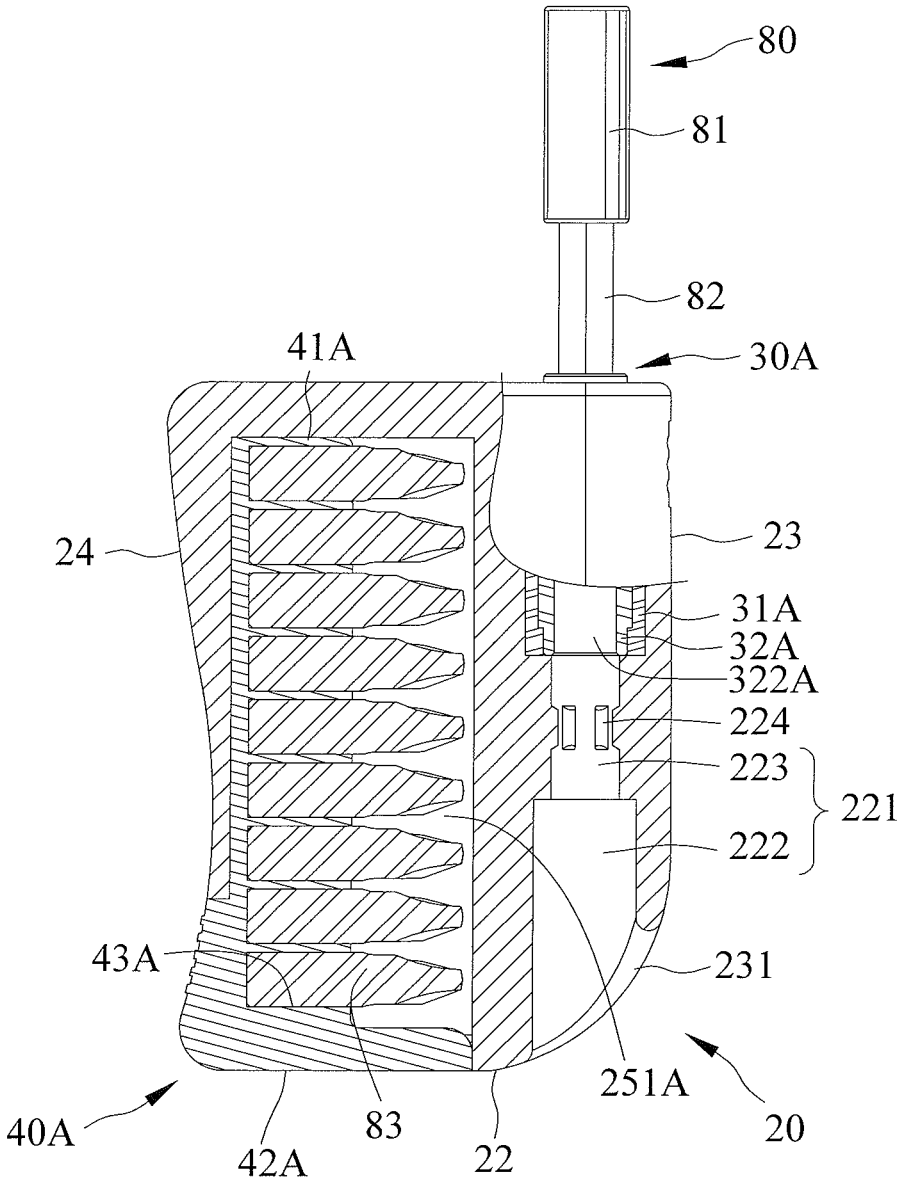
FIG. 13 shows a side view of the compact tool box of FIG. 11 with portions cross sectioned.
Figure 14:
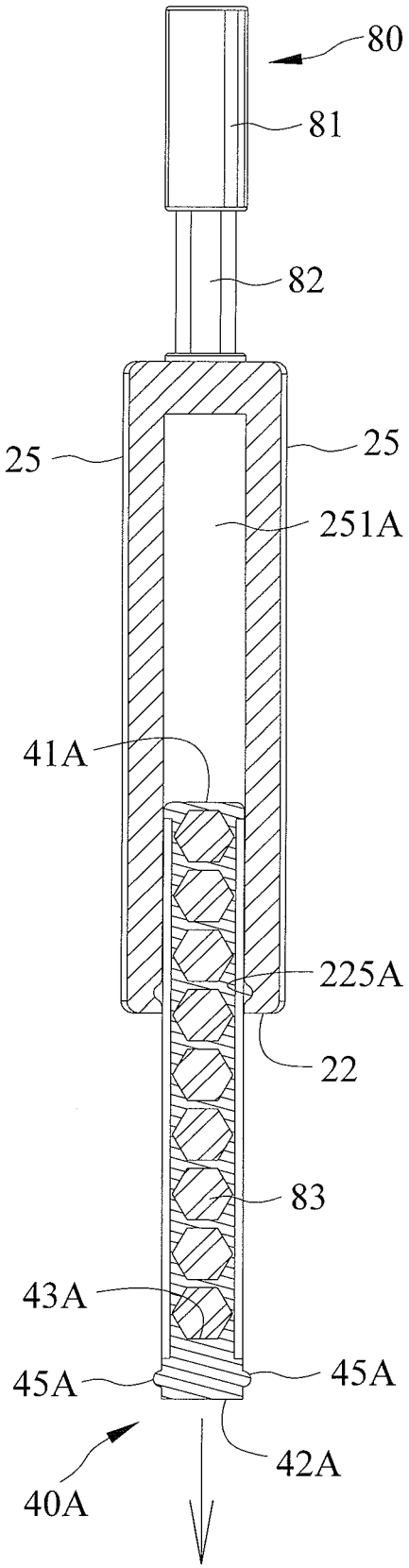
FIG. 14 shows a cross sectional view of the compact tool box of FIG. 11 with a mounting plate being removed.

FIG. 10 shows a tool box 10 of a second embodiment according to the preferred teachings of the present invention which is substantially the same as the first embodiment except that main body 31 of ratcheting mechanism 30 of this embodiment includes a cylindrical receiving groove 311 that is in communication with second section 223 of insertion groove 221. Receiving groove 311 has an inner diameter larger than that of driving groove 321. Thus, receiving groove 311 can receive a portion of small diameter portion 82 of shank 80 inserted in insertion groove 221, effectively reducing first spacing D1 of body 20 (FIG. 4) to allow easy carriage of body 20.

FIGS. 11-14 show a tool box 10 of a third embodiment according to the preferred teachings of the present invention which is substantially the same as the first embodiment except for ratcheting mechanism 30A. Specifically, ratcheting mechanism 30A of this embodiment includes a main body 31A, a ratchet wheel 32A having a driving groove 321A and a receiving groove 322A, and a switch device 33A having a switch 331A that is operated by axial pushing instead of rotating. However, other forms and shapes of ratcheting mechanism 30A can be utilized according to the teachings of the present invention. Switch device 33A is received in an exposed portion 212A of body 20. In this embodiment, exposed portion 212A is in the form of a slot in first side 23 and in communication with compartment 211 of body 20.

Furthermore, in this embodiment, receiving space 251A of body 20 has an opening 252A in force-receiving portion 22 and in second side 24. However, opening 252A can be formed in force-receiving portion 22 only. Rack 40A can be placed in receiving space 251A via opening 252A in force-receiving portion 22 and can be removed out of body 20 via force-receiving portion 22. Receiving space 251A can be sealed by rack 40A in the storage position received in receiving space 251A. Rack 40A includes a mounting portion 41A facing receiving space 251A and an outer side 42A opposite to receiving space 251A. Outer side 42A seals opening 252A of receiving space 251A. Mounting portion 41A of rack 40A includes a plurality of bit-receiving grooves 43A for receiving bits 83. Bit-receiving grooves 43A are arranged in a single row in first direction X such that receiving space 251A of body 20 only receives a row of bits 83, effectively reducing third spacing D3 of body 20 in third direction Z and allowing easy carriage of tool box 10.

Rack 40A includes an engaging portion 45A in each of two sides thereof. Engaging portion 45A is in the form of a ridge having semi-circular cross sections. Each lateral wall 25 has an engaging groove 225A adjacent to force-receiving portion 22. Engaging portions 45A of rack 40A are engaged in engaging grooves 225A to prevent undesired disengagement of rack 40A from receiving space 251A. However, engaging portions 45A can be forcibly disengaged from engaging grooves 225A by applying force to rack 40A to allow removal of rack 40A.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. An open end wrench comprising:

a body including a front end and a force-receiving portion spaced from the front end in a first direction, with the body further including first and second sides spaced in a second direction perpendicular to the first direction, with the body further including first and second lateral walls spaced in a third directionyerpendicular to the first and second directions and extending between the front end and the force-receiving portion, with the first and second lateral walls, the front end, and the force-receiving portion integrally formed as a single and inseparable component of a same material, with the front end including a compartment, with a receiving space defined between the first and second lateral walls and having an opening in the second side or the force-receiving portion;

a ratcheting mechanism including a main body mounted in the body, a ratchet wheel rotatablv received in the main body, and a switch device for controlling the ratchet wheel to be rotatable in a clockwise or counterclockwise direction or to be not rotatable in either of the clockwise and counterclockwise directions, with the ratchet wheel rotatable about a rotating axis parallel to the first direction, with the ratchet wheel located in a quarter corner of the body adjacent to the front end and the first side, with a driving groove defined in an end of the ratchet wheel and extending along the rotating axis, with the driving groove adapted for engaging and driving a shank to rotate, with the force-receiving portion including an insertion groove extending in the first direction, with the insertion groove receiving the shank when not in use, with the insertion groove in communication with the compartment of the body and extending along the rotating axis of the ratchet wheel; and a rack removably received in the receiving space of the body via the opening, with the rack adapted to receive a plurality of bits.

2. The tool box as claimed in claim 1, with the insertion groove including first and second sections, with the first section having an opening in the force-receiving portion, with the second section in communication with the compartment and located intermediate the first section and the compartment, with the first section having an inner diameter, with the second section having an inner diameter smaller than the inner diameter of the first section, with the shank including a large diameter portion and a small diameter portion, with the first and second sections respectively receiving the large and small diameter portions of the shank when not in use.

3. The tool box as claimed in claim 2, with the insertion groove including a plurality of annularly spaced protrusions formed on an inner periphery of the second section for clamping the small diameter portion of the shank.

4. The tool box as claimed in claim 1, with the first side of the body extending between the front end and the force-receiving portion, with the first side including a rounded corner formed in a joining area between the first side and the force-receiving portion.

5. The tool box as claimed in claim 1, with the rack including a mounting portion facing the receiving space and an outer side opposite to the receiving space, with the outer side sealing the opening of the receiving space, with the mounting portion of the rack including a plurality of bit-receiving grooves for receiving the bits.

6. The tool box as claimed in claim 5, with the bit-receiving grooves arranged in a single row in the first direction.

7. The tool box as claimed in claim 6, with the opening formed in the second side of the body, with the rack including an engaging portion in each of two ends thereof, with the body including two engaging grooves respectively in the front end and the force-receiving portion and located adjacent to the second side, with the engaging portions of the rack releasably engaged in the two engaging grooves of the body.

8. The tool box as claimed in claim 6, with the opening formed in the force-receiving portion of the body, with the rack including an engaging portion in each of two sides thereof, with each of the first and second lateral walls having an engaging groove adjacent to the force-receiving portion, with the engaging portions of the rack releasably engaged in the engaging grooves of the body.

9. The tool box as claimed in claim 1, with a first maximum dimension of the body in the first direction between the front end and the force-receiving portion defining a first spacing, with a second maximum dimension of the body in the second direction between the first and second sides defining a second spacing, with a third maximum dimension of the body in the third direction between the first and second lateral walls defining a third spacing, with the third spacing smaller than the second spacing, with the second spacing smaller than the first spacing, with the body having a first radius and a second radius in the second direction and having a same rotating axis, with the first radius equal to a spacing between the first side of the body and the rotating axis in the second direction, with the second radius equal to a spacing between the second side of the body and the rotating axis in the second direction, with the second spacing equal to a sum of the first radius and the second radius, with the second radius larger than the first radius.

10. The tool box as claimed in claim 9, with the first radius smaller than the third spacing.

11. The tool box as claimed in claim 10, with the first radius not larger than half of the third spacing.

12. The tool box as claimed in claim 11, with the rotating axis of the ratchet wheel having equal spacing to the first and second lateral walls in the third direction.

13. An open end wrench comprising:

a body including a front end and a force-receiving portion spaced from the front end in a first direction, with the body further including first and second sides spaced in a second direction perpendicular to the first direction, with the body further including first and second lateral walls spaced in a third direction perpendicular to the first and second directions and extending between the front end and the force-receiving portion, with the first and second lateral walls, the front end, and the force-receiving portion integrally formed as a single and inseparable component of a same material, with the front end including a compartment, with a receiving space defined between the first and second lateral walls and having an opening in the second side or the force-receiving portion;

a ratcheting mechanism including a main body mounted in the body, a ratchet wheel rotatably received in the main body, and a switch device for controlling the ratchet wheel to be rotatable in a clockwise or counterclockwise direction or to be not rotatable in either of the clockwise and counterclockwise directions, with the ratchet wheel rotatable about a rotating axis parallel to the first direction, with the ratchet wheel located in a quarter corner of the body adjacent to the front end and the first side, with a driving groove defined in an end of the ratchet wheel and extending along the rotating axis, with the driving groove adapted for engaging and driving a shank to rotate, with the ratchet wheel including another end opposite to the driving groove, with the other end of the ratchet wheel including a cylindrical receiving groove extending along the rotating axis, with the driving groove having an inner diameter, with the receiving groove having an inner diameter larger than the inner diameter of the driving groove, with the receiving groove receiving a portion of the shank inserted in an insertion groove; and a rack removably received in the receiving space of the body via the opening, with the rack adapted to receive a plurality of bits.

14. The tool box as claimed in claim 13, with the ratchet wheel including a stop having a through-hole, with a magnet securely received in the through-hole and attracting the portion of the shank received in the driving groove or the receiving groove.

15. The tool box as claimed in claim 14, with the switch device including two engagement members, with the switch device including a switch operable to control an engagement relation between the two engagement members and the ratchet wheel with the ratchet wheel rotatable in the clockwise or counterclockwise direction or not rotatable in either of the clockwise and counterclockwise directions.

16. An open end wrench comprising:

a body including a front end and a force-receiving portion spaced from the front end in a first direction, with the body further including first and second sides spaced in a second direction perpendicular to the first direction, with the body further including first and second lateral walls spaced in a third direction perpendicular to the first and second directions and extending between the front end and the force-receiving portion, with the first and second lateral walls, the front end, and the force-receiving portion integrally formed as a single and inseparable component of a same material, with the front end including a compartment, with a receiving space defined between the first and second lateral walls and having an opening in the second side or the force-receiving portion;

a ratcheting mechanism including a main body mounted in the body, a ratchet wheel rotatably received in the main body, and a switch device for controlling the ratchet wheel to be rotatable in a clockwise or counterclockwise direction or to be not rotatable in either of the clockwise and counterclockwise directions, with the ratchet wheel rotatable about a rotating axis parallel to the first direction, with the ratchet wheel located in a quarter corner of the body adjacent to the front end and the first side, with a driving groove defined in an end of the ratchet wheel and extending along the rotating axis, with the driving groove adapted for engaging and driving a shank to rotate, with the main body of the ratcheting mechanism including a cylindrical receiving groove extending along the rotating axis, with the driving groove having an inner diameter, with the receiving groove having an inner diameter larger than the inner diameter of the driving groove, with the receiving groove receiving a portion of the shank inserted in an insertion groove; and a rack removably received in the receiving space of the body via the opening, with the rack adapted to receive a plurality of bits.

17. The tool box as claimed in claim 16, with the ratchet wheel including a stop having a through-hole, with a magnet securely received in the through-hole and attracting the portion of the shank received in the driving groove or the receiving groove.

18. The tool box as claimed in claim 17, with the switch device including two engagement members, with the switch device including a switch operable to control an engagement relation between the two engagement members and the ratchet wheel with the ratchet wheel rotatable in the clockwise or counterclockwise direction or not rotatable in either of the clockwise and counterclockwise directions.

* * * * *